US006398001B1

(12) United States Patent
Hutchinson et al.

(10) Patent No.: US 6,398,001 B1
(45) Date of Patent: Jun. 4, 2002

(54) COIN VALIDATOR

(75) Inventors: Derek Hutchinson, Wokingham; Timothy Peter Waite, Fleet, both of (GB)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/367,032

(22) PCT Filed: Feb. 23, 1998

(86) PCT No.: PCT/GB98/00576

§ 371 (c)(1),
(2), (4) Date: Oct. 5, 1999

(87) PCT Pub. No.: WO98/37522

PCT Pub. Date: Aug. 27, 1998

(30) Foreign Application Priority Data

Feb. 24, 1997 (GB) ..... 9703769

(51) Int. Cl.[7] ..... G07D 5/08
(52) U.S. Cl. ..... 194/317
(58) Field of Search ..... 194/317, 318, 194/319

(56) References Cited

U.S. PATENT DOCUMENTS

| | | | | |
|---|---|---|---|---|
| 3,870,137 A | * | 3/1975 | Fougere | 197/317 |
| 4,601,380 A | * | 7/1986 | Dean et al. | 194/318 |
| 4,742,903 A | | 5/1988 | Trummer | 194/317 |
| 4,754,862 A | | 7/1988 | Rawicz-Szczerbo et al. | 194/303 |
| 4,842,119 A | | 6/1989 | Abe | 194/317 |
| 4,989,714 A | | 2/1991 | Abe | 194/317 |
| 5,002,174 A | | 3/1991 | Yoshihara | 194/317 |
| 5,048,663 A | | 9/1991 | Abe | 194/317 |
| 5,056,644 A | | 10/1991 | Parker | 194/318 |
| 5,080,216 A | | 1/1992 | Abe | 194/317 |
| 5,158,166 A | | 10/1992 | Barson | 194/319 |
| 5,263,566 A | | 11/1993 | Nara et al. | 194/318 |

FOREIGN PATENT DOCUMENTS

| | | |
|---|---|---|
| EP | 0 146 251 A1 | 6/1985 |
| EP | 0 202 378 A2 | 11/1986 |
| EP | 0 213 283 A1 | 3/1987 |
| GB | 2 135 095 | 8/1984 |
| GB | 2 151 062 A | 7/1985 |
| GB | 2 169 429 A | 7/1986 |
| GB | 2 234 619 A | 2/1991 |
| WO | WO 91/02334 | 2/1991 |
| WO | WO 91/03032 | 3/1991 |
| WO | WO 93/04448 | 3/1993 |
| WO | WO 93/22747 | 11/1993 |

* cited by examiner

*Primary Examiner*—F. J. Bartuska
(74) *Attorney, Agent, or Firm*—Fish & Richardson P.C.

(57) ABSTRACT

An oval-shaped sensor is used to measure the material content of the outer ring of a bicolour coin, the coil being mounted on a ferrite whose inner portion has a diameter which is wider than the inner disc of the bicolour coin so that eddy currents are confined to the outer ring. A thickness sensor may be mounted within the oval sensor, and a separate coil is used for measuring the material content of the inner disc. The thickness sensor may also be used for measuring material down to a different depth, for validating clad coins. The oval sensor is used also for diameter measurement.

16 Claims, 2 Drawing Sheets

COIN VALIDATOR

Figure 1:
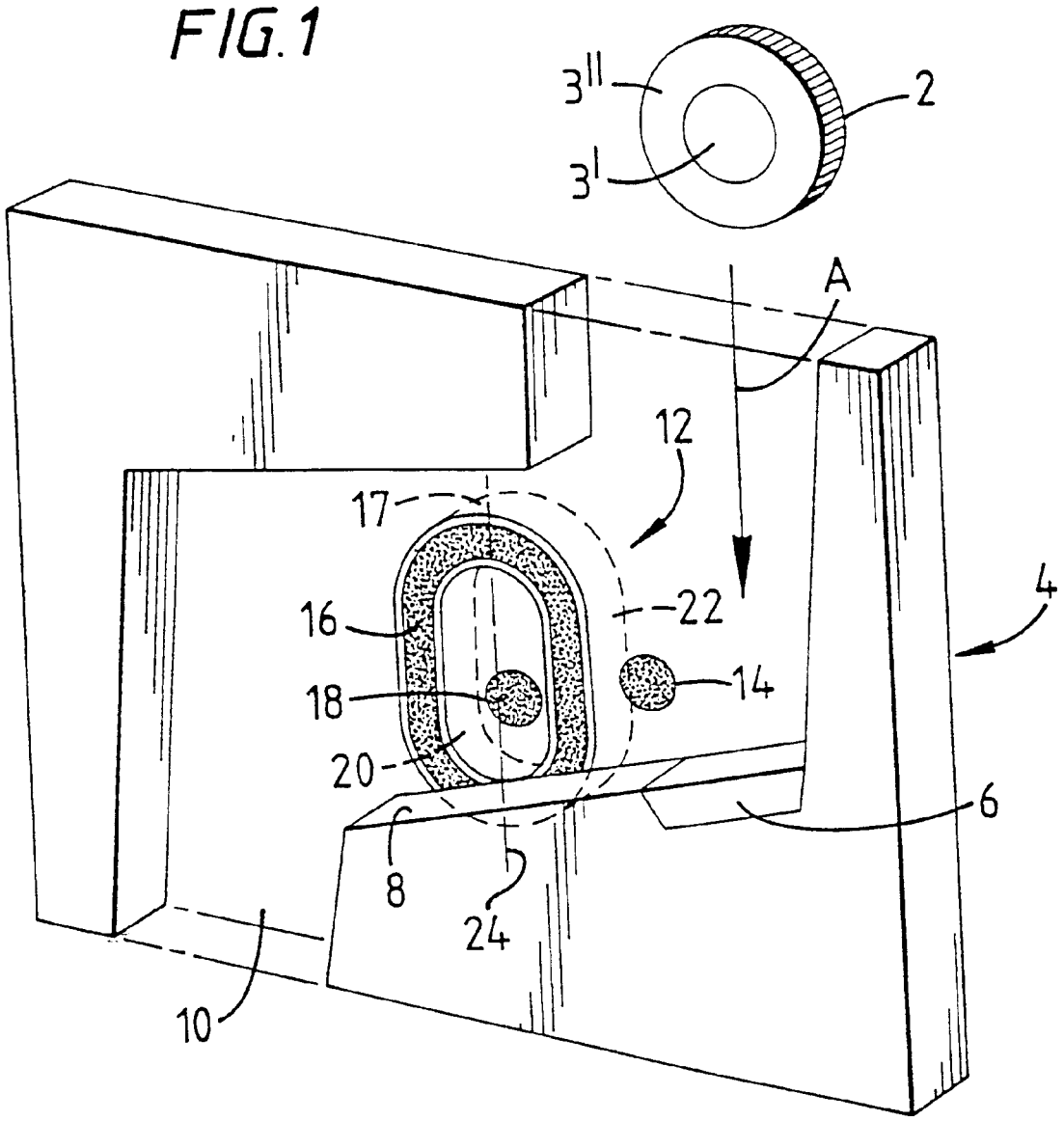

This invention relates to apparatuses and methods for validating coins.

It is known to provide in such apparatuses one or more inductive sensors which generate electromagnetic fields in a test region through which a coin is arranged to travel. The coin influences the field to an extent dependent upon the dimensions and/or material of the coin. The inductive sensor, and the circuit to which it is coupled may be arranged so that the influence of the coin on the electromagnetic field is predominantly determined by the coin material, the coin diameter or the coin thickness.

Some coins are formed of a composite of two or more materials, and have an inner disc surrounded by an outer ring, the disc having a different metallic content from that of the outer ring. Often, each of the inner disc and the outer ring is of an homogeneous metal, but it would be possible for one or the other or both to be formed of two or more metals. For example, the inner disc may be formed of a core material with outer cladding of a different material. Coins which have an inner disc of different material content to that of a surrounding ring will be referred to herein as "bicolor" coins. (This expression is intended to encompass the possibility of any number of concentric rings of different materials.)

Various techniques have been developed for validating bicolor coins. One example is shown in WO-A-93/22747. The present invention is directed to a different technique which enables validation of bicolor coins using a compact validation apparatus. Other aspects are directed to validation of clad coins (formed e.g. by an outer material rolled on top of an inner material, or by plating the inner material), which may or may not be bicolor.

Various aspects of the invention are set out in the accompanying claims.

According to another aspect, the material content of the outer ring of the bicolor coin is measured using a relatively large coil wound on a ferrite whose diameter exceeds the diameter of the inner disc of each bicolor coin to be validated by the apparatus. In this way, the eddy currents generated when the coin passes the coil, and when the inner disc is within the diameter of the ferrite, are substantially confined to the outer ring of the coin, so that it is possible to take a measurement of the material content of the outer ring of the coin which is not significantly influenced either by the material content of the inner disc or by the characteristics of the interface between the disc and the outer ring.

According to certain aspects of the present invention a coil which is used to determine the material content of the outer ring of the coin is also used for determining the coin diameter. According to a still further aspect of the invention, a coil used to determine the material content of the outer ring of the coin surrounds a further coil which is used to perform a different test (e.g. a thickness test) on the coin. These aspects of the invention provide for better discrimination while maintaining a compact size of the validator.

There may be provided an additional coil for measuring the material content of the inner disc of the coin.

Figure 2:
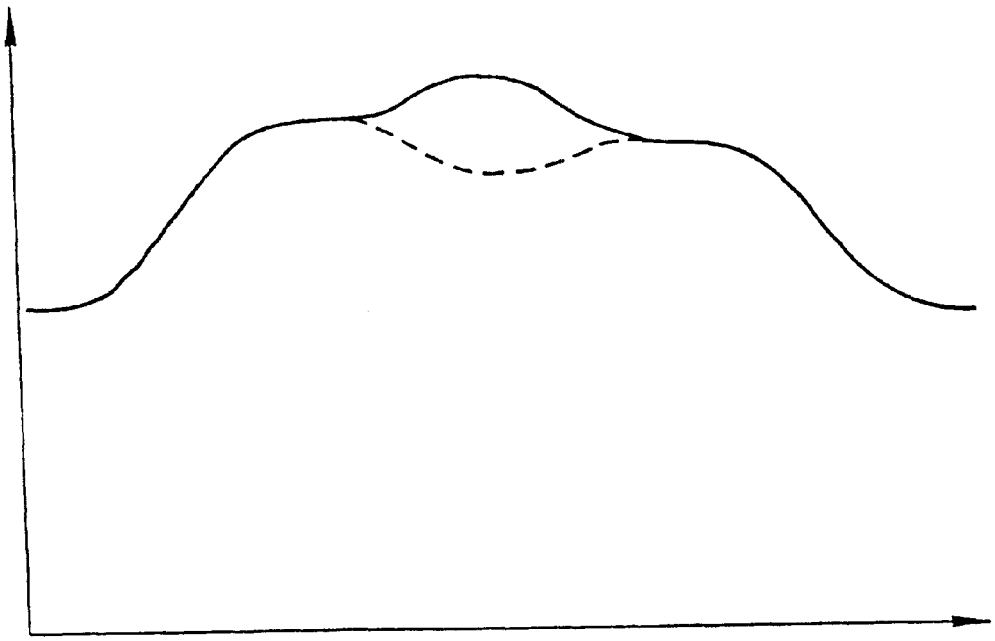
Figure 3:
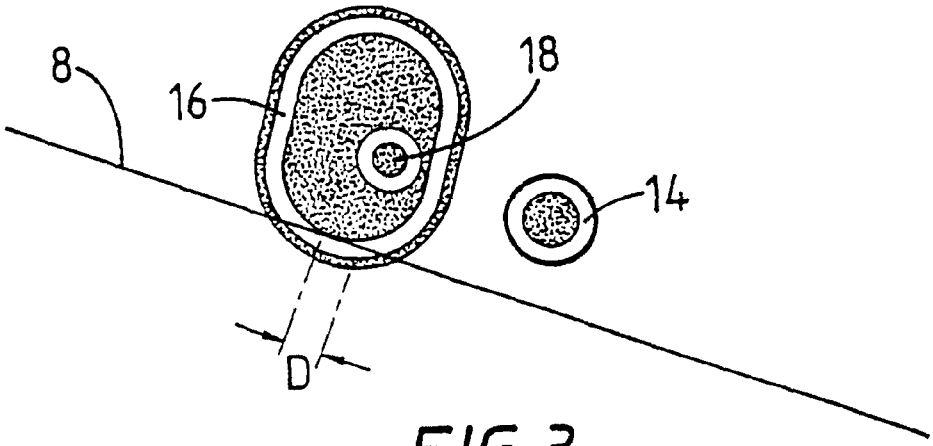

An arrangement embodying the invention will now be described by way of example with reference to the accompanying drawings, in which:

FIG. 1 schematically illustrates a flight deck of a coin validator in accordance with the invention;

FIG. 2 illustrates possible profiles of measurements taken as a coin passes along the flight deck; and FIG. 3 schematically illustrates the flight deck of a modified embodiment of the invention.

Referring to FIG. 1, coins, such as the bicolor coin illustrated at 2 which has an inner disc 3' and an outer ring 3", enter the validator 4 via a chute (not shown) and then fall in the direction of arrow A on to an energy-absorbing element 6. They then roll down a ramp 8 and enter an exit path 10.

As they roll down the ramp 8, the coins pass a test region 12. In this test region there are three inductive sensors, 14, 16 and 18. Each of these is a double-sided coil arrangement and the figure illustrates only those coils which are mounted on the flight deck itself. The other coils face the ones illustratedat 14. 16 and 18 and have a corresponding configuration and are mounted on the lid (not shown) of the validator. The coils 14, 16 and 18 are located behind a membrane separating the front surfaces of the coils from the surface of the flight deck but for purposes of clarity this membrane is not shown in the figure. The coins pass the coils 14.16 and 18 in close proximity thereto, but are spaced from the opposed coils by distances which depend on coin thickness.

The first sensor to be passed by the coin is formed by the coil 14 and the opposing coil of similar configuration on the lid, which are connected in a self-excited oscillator, in series-aiding configuration (although other configurations are possible). The coil 14 is sized and positioned so that it is substantially totally occluded by the inner disc 3' of the bicolor coin 2 (or of each bicolor coin, if different bicolor coins are to be validated). The coil operates at a relatively low frequency, e.g. around 25 kHz, and provides an output primarily indicative of material content of the inner disc of the coin.

As the coin moves past the coil 14, the amplitude of the oscillator will shift to an extent dependent upon the material content of the coin. Depending upon the relative material content of the outer ring and the inner disc, the amplitude may decrease monotonically until the inner disc is symmetrically disposed in front of the coil, and then increase monotonically as the coin departs from the coil area, as shown in solid line in FIG. 2 (in which the vertical axis represents amplitude attenuation and the horizontal axis represents time). Alternatively, the amplitude may decrease as the outer ring moves past the coil. increase to a certain extent as the inner disc moves past the coil (as indicated by the broken line in FIG. 2) and then decrease again as the trailing part of the outer ring passes the coil. For other coin materials the profile may be the inverse of either of those shown in FIG. 2.

In either case, an amplitude measurement is made when the inner disc fully occludes the coil 14, and the amplitude shift (relative to when no coin is present) measured at this point is representative of the material content of the inner disc. It is preferred but not essential, that the amplitude shift rather than the absolute amplitude be used for this purpose.

If desired, the frequency of the output of the coil 14 can also be monitored to obtain additional information about the coin. Preferably, the frequency at the point when the inner disc is symmetrically disposed in front of the coil is used for this purpose and more preferably the relationship between this frequency and the idle frequency when no coin is present.

As indicated above, the profile of the amplitude output of sensor 14 will vary depending upon the nature of the coin and the relative properties of the metals forming the inner and outer parts of the coin. Various alternative techniques could be used for ensuring that the measurement is taken at the appropriate time. For example:

(a) the output profile of the signal from the sensor coils is likely to be either a single peak (if the coin is homogeneous or if a bicolor coin gives an output profile as shown in solid line in FIG. 2), or two peaks with an intervening trough (as shown by the broken line in FIG. 2). Accordingly, it is possible to use peak detectors, which are very well known per se, coupled to the output of the sensors. These peak detectors could be in the form of hardware or software. When the output from the sensor starts to change, to indicate that a coin is arriving, a timer is started. Any positive-going or negative-going peaks are detected until the end of a predetermined time period. If two positive-going peaks are detected, then the intervening negative-going peak is used for the basis of the measurement. Alternatively, if only one positive-going peak is detected, this is used as the basis.

(b) The entire profile of the sensor output can be sampled at a predetermined rate and the samples stored so that, after the coin has passed, the profile can be examined to determine the position and magnitude of any peaks.

(c) One or more sensors can be used to indicate when the coin is in the correct position for taking a measurement reading. For example, one or more of the sensors may be positioned such that its output can be used to determine the timing at which a reading is taken from another one of the sensors. Alternatively, an additional sensor in the form of an optical detector could be positioned at a location such that it provides an output when the coin is symmetrically positioned in front of the coil 14, so that a reading is taken at this time. If the validator is arranged to test only one type of bicolor coin (possibly in addition to other non-bicolor coins), then a single optical detector may be adequate for determining when the coin is in the correct position. This may also be adequate if the validator is arranged to test two different types of bicolor coins of similar diameter. However, if the validator is intended to test bicolor coins of different diameters, it is preferable that the detector be such that it is not dependent upon diameter. For example, the optical detector may comprise an array of individual detector elements aligned appropriately, the arrangement being such that the timing of the sensor measurement is triggered in response to one of the detector elements detecting the arrival of a coin. In this situation, the array may also be used for diameter measurement.

(d) The frequency measurement is predominantly dependent upon the change in inductance of the coil, and is likely to exhibit a single peak when the coin is positioned symmetrically with respect to the coil. Accordingly, the arrangement may be such that the amplitude measurement is triggered upon detection of a peak in the frequency variation. (The frequency shift for this or other sensors may sometimes exhibit a more complicated waveform, such as that shown by the broken line in FIG. 2, in which case the techniques used above may be employed also or alternatively for the frequency measurement.)

In the case of alternatives (a), (b) and (c), the circuit may be arranged so that the frequency measurement is taken at the same time as the amplitude measurement.

After the leading edge of the coin has passed the coil 14, the coin starts to occlude the coil 16. All three coils (and the corresponding coils on the lid) are wound on ferrites, but for the purposes of clarity the only fente shown is that Qn which the coil 16 is wound, indicated at 17. This ferrite is generally elongate and oval in shape and has a channel defined by inner and outer walls 20 and 22 in which the coil 16 is disposed. The ferrite 17 is arranged so that the lower part of the coil 16 extends just below the surface of the ramp 8. The longer axis 24 of the oval ferrite 17 extends substantially perpendicularly to the coin path. The coil need not be wound directly on the ferrite; instead it may be wound on a former which is placed around the inner wall 20 of the ferrite.

In a particular embodiment, the coil 16 is approximately 39 millimetres in height and 30 millimetres in width, and the inner diameter of the ferrite (i.e. the part around which the coil 16 is wound) is approximately 20 millimetres when measured in the direction of coin travel. This dimension exceeds the largest diameter of the inner disc 3' of any bicolor coin to be validated by the validator. This means that when a bicolor coin 2 is symmetrically disposed in front of the coil 16, substantially all the eddy currents generated by the coil are confined to the outer ring 3" of the coin.

The coil 16 and the opposed coil in the lid are driven in a self-excited oscillator operating at approximately 100 kHz, the coils being coupled in parallel configuration. Again other configurations are possible. The amplitude and the frequency as the coin passes the coil are monitored.

As will be appreciated from EP-A-17370, the coil 16 is well-suited for measuring the diameter of the coin and in this embodiment a diameter measurement is based on the frequency of the coil output. Also, a measurement indicative of the material content of the outer ring of the coin is based on the amplitude of the coil output. For these purposes, preferably, the measurements are based on the frequency and amplitude when the coin is symmetrically disposed in front of the coil 16, and preferably the measurements are based on the relationship between the frequency and the amplitude at this point and the respective idle values.

Because the coil 16 is selected, the amplitude measurement is effectively a measurement of the "Q" of the coil. Because the coil 16 is relatively large then unlike the coil 14 the amplitude measurement is likely to vary monotonically until a peak is reached after which the amplitude will vary monotonically in the opposite direction. Accordingly a simple peak detector should be sufficient to take the amplitude measurement (and a separate peak detector can be used for the frequency measurement). However, it is possible that the amplitude measurement will exhibit a more complicated profile, similar to that shown in FIG. 2. for example if the amplitude measurement is based predominantly on the resistance of the coil rather than the "Q", e.g. if the coil is directly driven (fixed frequency) rather than self-excited. In this situation, or indeed if desired for other reasons, any of the other techniques mentioned above for determining the correct timing for taking the amplitude measurement from the coil 14 can be used in addition or instead for the coil 16.

The coil 18 is located within a ferrite (not shown), which is itself positioned within the ferrite 17 of the coil 16, these ferrites serving to isolate the coils 16 and 18. Further isolation is achieved by virtue of the fact that the coil 18 operates at a much higher frequency. The coil 18 and its counterpart in the lid are separately excited at slightly different frequencies, e.g. 1.3 MHz and 1.6 MHz. These coils operate to measure thickness using the techniques described in U.S. Pat. No. 5,337,877, which involve taking separate readings from the coils, each dependent on the distance between the coil and the adjacent coin surface. Preferably, the coil 18 is also sized and positioned so that it is completely occluded by the inner disc 3' of any bicolor coin to be validated.

It will be appreciated that the mounting of the coil 18 within the coil 16 has the advantages, including saving of space, mentioned in EP-A489 041.

The coil 18 is offset with respect to the lateral centre of the coil 16, preferably upstream of this centre, so that the peak measurement from the sensor coil 18 is taken at a different time from the measurements derived from the coil 16. This renders the processing of the measurements easier, because it separates the times at which the coil output readings upon which the measurements are based occur. It also facilitates the use of the same circuits, in a time-division multiplexed manner, for processing the electrical signals from the sensors, should this be desired.

In an alternative embodiment, the measurement from the coil 18 is taken at a timing determined by the amplitude or frequency output of sensor 16. This is facilitated if the coil 18 is located centrally within the coil 16, in which case a peak in the output from the coil 16 can trigger the measurement.

Although the illustrated ferrite 17 has a channel in which the coil 16 is mounted, such that the coil is bounded on its inner and outer edges by ferrite walls 20 and 22, the outer ferrite wall 22 is not so important as the inner portion including the wall 20. and could in some cases be omitted provided the construction is such that the coil 16 is otherwise adequately isolated. The inner portion, including the wall 20, on the other hand, serves to assist isolation of the coil 16 from the inner coil 18 and to prevent eddy currents from flowing in the inner disc 3' of the coin 2 when the coin is symmetrically positioned in front of the coil 16. Its presence therefore is of substantial advantage.

As a modification of the above-described embodiment, the coil 18, or the counterpart of the coil 18 on the lid, could operate additionally or alternatively at a substantially lower frequency, e.g. 400 kHz. This would enable the measurements from the coil 18 or its counterpart to be indicative not merely of thickness, but also of the material content of the inner disc 3'. However, because the frequency differs from that at which the coil 14 operates, the two material measurements taken of the inner disc by the coils 14 and 18 will be representative of the material profiles down to different depths, so this technique is particularly useful if the inner disc 3' is formed of a core material and outer cladding. If desired both the coil 18 and its counterpart on the lid could operate at substantially lower, different frequencies so that these two coils are used to take material measurements down to different depths within the coin.

The use of two opposed coils for measuring different (i.e. non-symmetrical) parts of the coin has clear space-saving advantages, in that it avoids the need for two successively-disposed sensors and is considered to be independently inventive. The advantages are enhanced if the two coils (18 and its counterpart) are located within other coils, and/or are used for other purposes (e.g. thickness measurements).

The additional material measurement made by the coil 18, or the counterpart on the lid, is preferably based on measurements of changes in amplitude, as with the coil 14, and similar arrangements can be provided if necessary for controlling the timing of the amplitude measurement.

The function of the coil 14 and its counterpart on the lid may instead be performed by the coil 18 and its counterpart, and vice versa. Thus, for example, the coil 14 and its counterpart may be driven at two respective frequencies, e.g. 25 kHz and 400 kHz, with the amplitudes of the output used to measure the material of any cladding at the inner disc of the coin and as well as the core material of the inner disc. The frequency shifts can be used to measure thickness.

In a modification of the above-described embodiment, the coil 16 and its counterpart on the lid are no longer interconnected, and are driven at different frequencies so that the measurements therefrom are representative of the material profiles of the outer ring down to different depths. This is usefull if the outer ring 3" is formed of a core material and outer cladding.

The arrangement of FIG. 3 is similar to that of FIG. 1 (and uses like reference numbers for like integers), except as detailed below, and any variations discussed herein with respect to FIG. 1 may also be applied to the embodiment of FIG. 3. and vice versa.

In FIG. 3 the coin ramp is illustrated at 8. The regions shown in black represent the areas of the ferrites upon which the three coils are wound. The coil 14 and its counterpart are now located downstream of the coils 16 and 18. The inner portion of the ferrite 17 is substantially solid, except for an area within which the coil 18 is wound. Because the width of the inner portion of the ferrite 17 exceeds the diameter of the inner disc 3' of any bicolor coil to be validated, the field produced by the coil 16 is substantially absent from this inner disc when the material of the outer ring 3" is measured, as in the FIG. 1 arrangement.

The arrangement of FIG. 3 has the advantage that the diameter measurement performed by the coil 16 is effective for distinguishing between many different coins, so that by performing the diameter test first, it is possible to reduce subsequent processing by taking into account only those acceptance criteria relevant to the possible denominations identified by the diameter test. On the other hand, the FIG. 1 arrangement is sometimes advantageous because a small sensor can be positioned nearer the entry, thus allowing a more compact configuration.

By way of example the coils 14, 16 and 18 may be arranged such that:

(a) the coil 16 (and its counterpart) operate at substantially 67 kHz and measure diameter and the material of the outer ring 3", as in FIG. 1. Because of the low frequency, if a clad coin (whether or not bicolor) is being tested, the coil 16 can be used to determine the material content of the core and is relatively unaffected by the cladding;

(b) the coil 14 (and its counterpart) operate at substantially 400 kHz.

This performs a material measurement at the centre part 3' of the coin (if it is bicolor). If the coin is clad, then the material measurement will be heavily dependent on the material of the cladding, because of the use of a frequency which is relatively high for a material measurement. Also, if the coin is bicolor, the measurement will be relatively unaffected by variations in the joint resistance between the inner disc and the outer ring, because the contact between these two tends to be confined to the centre (measured in the direction of thickness) of the coin. (For similar reasons, i.e. to avoid resistance effects, the coil 16 and its counterpart could be additionally or alternatively driven at a higher frequency.) To achieve this effect the frequency is preferably from 200 kHz to 1 MHz. In making the material measurement, instead of determining the amplitude shift relative to the idle value (with no coin present) it would be possible (assuming the amplitude waveform is as indicated by the broken line in FIG. 2) to measure the difference between the central trough and one or both of the adjacent peaks. The frequency shift is used as a measure of thickness;

(c) The coil 18 (and its counterpart) are operated at substantially 67 kHz. Amplitude shifts represent the material content of the inner disc 3' of the coin (if bicolor) and predominantly the content of the core of the coin (if clad). In this case the coil 18 is offset downstream from the centre line of the coil 16 by distance D as illustrated. The coil 18 output is read at a timing determined by the output of coil 16 (e.g. when the waveform of for example the frequency output begins to fall, indicating that the coil is starting to depart from the coil 16).

In the above embodiments, each of the sensors comprises a double-sided coil but instead each sensor may comprise only a single coil.

The disclosures of WO-A-93/2747, EP-A-17370, U.S. Pat. No. 5,337,877 and EP-A-489041 are incorporated herein by reference. In particular it will be appreciated that the techniques used for processing the outputs of the coils and checking whether these are indicative of genuine coins may be as described in those specifications or as is per se well known in the art. For example, it is well known to take measurements of coins and apply acceptability tests which are normally based on stored acceptability data. One common technique (see. e.g. GB-A-1 452 740) involves storing "windows". i.e. upper and lower limits for each test. If each of the measurements of a coin falls within a respective set of upper and lower limits then the coin is deemed to be an acceptable coin of a particular denomination. The acceptability data could instead represent a predetermined value such as a median, the measurements then being tested to determine whether they lie within predetermined ranges of that value. Alternatively, the acceptability data could be used to modify each measurement and the test would then involve comparing the modified result with a fixed value or window. Alternatively the acceptability data could be a look-up table which is addressed by the measurements, and the output of which indicates whether the measurements are suitable for a particular denomination (see, e.g. EP-A-0 480 736, and U.S. Pat. No. 1,951,799). Instead of having separate acceptance criteria for each test, the measurements may be combined and the result compared with stored acceptability data (cf. GB-A-2 238 152 and GB-A-2 254 949). Alternatively, some of these techniques could be combined, e.g. by using the acceptability data as coefficients (derived, e.g. using a neural network technique) for combining the measurements, and possibly for performing a test on the result. A still further possibility would be for the acceptability data to be used to define the conditions under which a test is performed (e.g. as in U.S. Pat. No. 1,625,852).

References herein to coins "to be validated" by the validator are intended to relate to coins of a denomination whose population exhibits average property measurements which fall within the ranges deemed by the validator to represent a particular type of coin.

The invention has been described in the context of coin validators, but it is to be noted that the term "coin" is employed to mean any coin (whether valid or counterfeit). token, slug, washer, or other metallic object or item, and especially any metallic object or item which could be utilised by an individual in an attempt to operate a coin-operated device or system. A "valid coin" is considered to be an authentic coin token, or the like, and especially an authentic coin of a monetary system or systems in which or with which a coin-operated device or system is intended to operate and of a denomination which such coin-operated device or system is intended selectively to receive and to treat as an item of value.

Our co-pending U.K. patent application No. GB-A-2,323, 199, entitled "Method and Apparatus for Validating Coins", filed Feb. 24th, 1997, also relates to validating bicolor coins, and the contents of that application are incorporated herein by reference.

What is claimed is:

1. A method of validating a bicolor coin having an inner disc and an outer ring, comprising causing the coin to pass an inductive sensor comprising a coil disposed around a ferrite so arranged that the field produced by the coil extends around, and is substantially absent from, an area which is wider than the inner disc of the coin, and deriving from the influence of the coin on the coil a measurement primarily representative of the material of the outer ring of the coin.

2. A method as claimed in claim 1, including deriving a measurement indicative of coin diameter from the influence of the coin on the coil.

3. A method as claimed in claim 1, including taking a further measurement of the coin using a further inductive sensor, said further sensor being mounted within the first-mentioned inductive sensor.

4. A method as claimed in claim 3, wherein the further inductive sensor produces an output predominantly indicative of coin thickness.

5. A method as claimed in claim 1, including using a separate inductive sensor for providing a measurement of the material content of the inner disc of the coin.

6. A method of validating a bicolor coin having an inner disc and an outer ring comprising causing the coin to pass an inductive sensor so arranged that, as the coin passes the sensor, there is a position in which the eddy currents generated by a field produced by the sensor are substantially confined to the outer ring of the bicolor coin, and deriving from the influence of the coin on the sensor a measurement indicative of the material content of the outer ring of the coin.

7. A method as claimed in claim 6, including obtaining a further measurement of a coin property from a second inductive sensor which is encircled by the first inductive sensor.

8. A method as claimed in claim 7, wherein the second inductive sensor is operable to provide a measurement indicative of coin thickness.

9. A method as claimed in claim 7, wherein the second inductive sensor is operable to provide a measurement indicative of material content.

10. A method as claimed in claim 9, including taking a measurement of material content from a third sensor, the material measurement from the third sensor and the second sensor being representative of the material content of the inner disc of the coin down to different depths within the coin.

11. A method as claimed in claim 6, including deriving from the first-mentioned sensor a measurement indicative of coin diameter.

12. A method of validating a bicolor coin having an inner disc and an outer ring, comprising using an inductive sensor to measure the material content of either the inner disc or the outer ring of the coin, the frequency of operation of the sensor being sufficiently high that the measurement is substantially unaffected by the contact resistance between the inner disc and the outer ring, and validating the bicolor coin based on the measurement.

13. A method of validating a coin using a first inductive sensor having a first output and comprising at least one first coil and a second inductive sensor having a second output comprising at least one second coil positioned within said first coil, the method comprising:

deriving a first measurement from the first output;

deriving a measurement timing from the first output;

deriving a second measurement from the second output at said measurement timing; and validating the coin if the first measurement and the second measurement satisfy predetermined criteria.

14. A method of validating a bicolor coin having an inner disc and an outer ring, comprising using three inductive sensors to take measurements predominantly dependent on the material content of the coin, the arrangement of the sensors and the frequencies at which they are driven being so arranged that an output of a first sensor is predominantly responsive to material content in the radially outer part of the coin, and outputs of a second and a third sensor are predominantly responsive to material content in the radially inner part of the coin, the outputs of the second and third sensors being responsive to material content of the coin down to different depths within the coin; and validating the coin if the outputs of the first, second and third sensors satisfy predetermined criteria.

15. A method as claimed in claim 14, wherein a diameter measurement is made using a further output of the first sensor.

16. A method as claimed in claim 14, wherein a thickness measurement is made using a further output of one of said second and third sensors.

* * * * *